United States Patent [19]

Levine

[11] Patent Number: 4,637,635

[45] Date of Patent: Jan. 20, 1987

[54] DOUBLE-BLIND LABELS

[76] Inventor: Richard A. Levine, 34 Lake Dr., North Brunswick, N.J. 08902

[21] Appl. No.: 804,044

[22] Filed: Dec. 3, 1985

[51] Int. Cl.[4] ..... B42D 15/00; G09F 3/00

[52] U.S. Cl. ..... 283/101; 283/81; 283/105; 434/349

[58] Field of Search ..... 283/81, 94, 98, 99, 283/101, 102, 105, 111; 434/348, 349, 262

[56] References Cited

U.S. PATENT DOCUMENTS 3,512,269 5/1970 Kunert ..... 434/349
3,993,814 11/1976 Cavender ..... 283/81
4,033,611 7/1977 Johnsen ..... 283/105
4,110,502 8/1978 Baer ..... 283/81
4,551,373 11/1985 Conlon ..... 283/105

*Primary Examiner*—Paul A. Bell
*Assistant Examiner*—Paul M. Heyrana, Sr.
*Attorney, Agent, or Firm*—Joel F. Spivak

[57] ABSTRACT

A carrier sheet has affixed thereto a multiplicity of separable, double-blind, multisection labels comprising a blind section, an open section and a record keeping section, the carrier sheet may be adapted for use in a computer printer to print information on the labels. The sections are designed to be used in double-blind drug tests.

3 Claims, 2 Drawing Figures

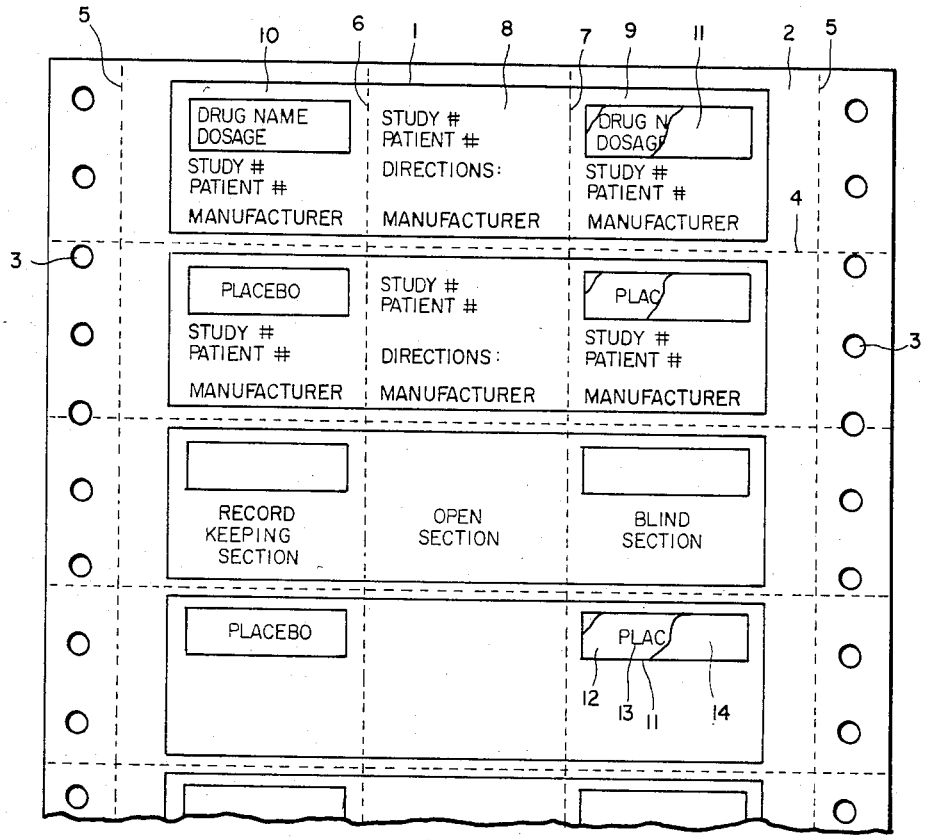
FIG. 1
FIG. 2
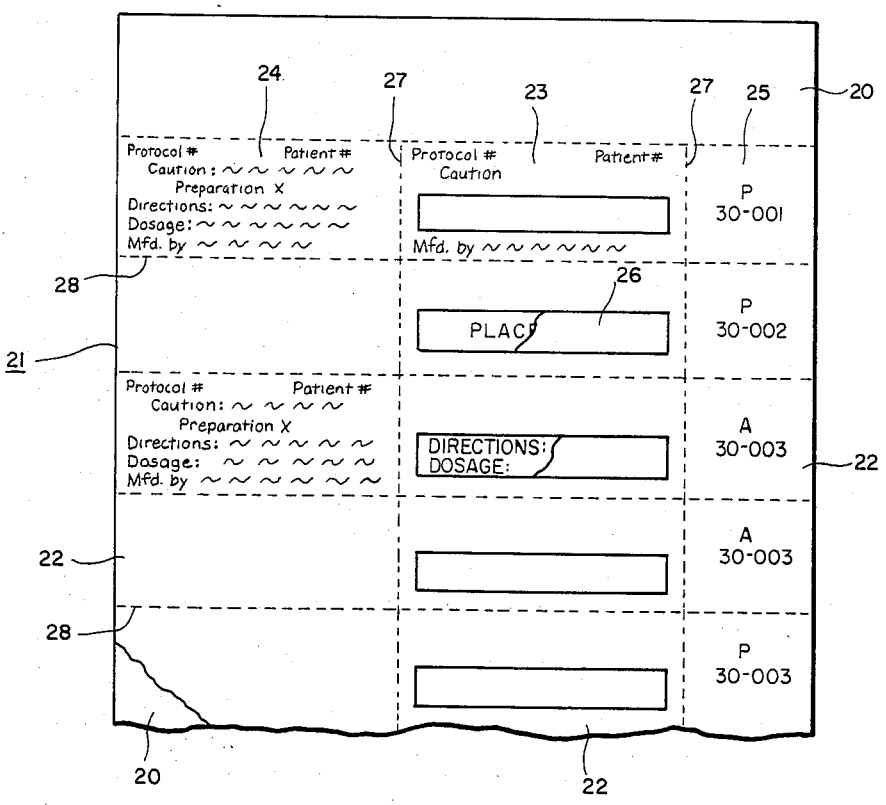

DOUBLE-BLIND LABELS

FIELD OF THE INVENTION

This invention relates to pressure sensitive labels and particularly to pressure sensitive labels useful in the administration of "double-blind" testing as often used in the pharmaceutical field.

BACKGROUND OF THE INVENTION

The term "double-blind" is used to define studies, e.g. drug studies, in which both the person administering the drug and the person receiving the drug does not know the potency, ingredients, etc. of the drug being tested or whether the particular material being administered is actually an active drug or a placebo.

In order to further the administration of double blind tests, pharmaceutical companies, laboratories, hospitals, physicians or anyone else involved in the testing of new drugs in accordance with the requirements of the U.S. Food and Drug Administration, need a means for providing "blind" and "double blind" labels for the drugs. Pressure sensitive labels have been used in the past for this purpose. However, the information concerning the patient number, protocol, drug lot, dosage, etc. which may differ as between labels would ordinarily have to be hand stamped or individually printed. Further, these labels were not adapted for use in computer controlled printers. It is therefore an object of this invention to provide a label which is capable of having all or most of the printed information provided in accordance with a computer program and automatically printed.

Also, no means were provided for a unitary multipart label wherein the blinded portion of the label did not have to be separately concealed, e.g. by means of enclosing this portion in a sealed envelope to prevent disclosure of the blinded information. It is another object to provide a label wherein the blinded information is self-concealed on the label, such that the information can be made visible at the appropriate time.

SUMMARY OF THE INVENTION

A pressure sensitive label on a carrier useful for double-blind testing comprises a carrier sheet on which a single or multiplicity of removable, double-blind self adhesive labels are affixed. The carrier sheet is perforated and the labels affixed thereto are die-cut and/or perforated into at least two sections including a blind section and at least one section selected from an open section and a manufacturers record keeping section, as hereinafter defined.

In a preferred embodiment the carrier sheet is provided with vertically spaced line holes adjacent the edges of the sheet so as to adapt it for use in standard computer printers.

BRIEF DESCRIPTION OF THE DRAWINGS

FIG. 1 is a top elevational view of an embodiment of the invention suitable for use with a computer printer.

FIG. 2 is an elevational view of another embodiment of the invention.

DETAILED DESCRIPTION OF THE INVENTION

Referring to FIG. 1, there is shown a novel pressure sensitive label 1 on a continuous carrier sheet 2 in accordance with the preferred embodiment of the present invention. The carrier sheet 2 is provided with a series of spaced, punched line holes 3 adjacent the right and left hand edges thereof adapted to allow the carrier sheet 2 to be used in standard computer printers. The surface of the carrier sheet 2 onto which the self-adhesive label 1 is removably affixed, must have a surface which allows the labels to adhere thereto but yet be removed therefrom without damage to the label 1 or its adhesive backing. Suitable carrier materials are well known in the art and are commercially available. They typically have a smooth, non-porous surface. For convenience and ease of separation, the carrier sheet 2 is preferably provided with a multiplicity of spaced horizontal perforations 4 extending in widely spaced horizontal intervals so as to allow separation of horizontally related sections of labels affixed thereto as well as a multiplicity of vertical perforations 5 extending along both sides of the continuous carrier sheet 2 adjacent the spaced line holes 3. The labels 1 are preferably die-cut and are provided with a pressure sensitive adhesive on the bottom surface thereof. The labels 1 are affixed to the carrier sheet 2 by means of the adhesive and are removable therefrom. The label as shown in the figure comprises three sections separable by spaced perforations 6 & 7 extending vertically along the label 1 and carrier sheet 2. The sections are termed the open section 8, the blind section 9 and the record keeping section 10. The open section 8 is that portion of the label 1 upon which is printed information related to the study such as drug study or protocol number, assigned patient number, directions and manufacturers name. This section does not indicate the potency or whether the contents of the container upon which the label is ultimately applied is an "active" drug or a placebo. This section will be adhered to the drug dispenser or container. The blind section 9 is that portion of the label upon which is generally printed all or most of the same information as appears on the open section 8 plus a blind area 11 on which is printed the actual ingredients, dosage and the like of the tested drug or placebo. This latter area 11 is "blinded" by a removable cover coat in such a way as is known in the art to prevent direct reading of the information protected by the cover coat. The purpose of this is to prevent prejudicing the results of a drug study or other test due to knowledge of what is being administered. Generally, the cover coat is provided by first printing one or more coats of varnish 12 over the printed information 13 followed by one or more coats of an opaque ink 14 which can be scratched off to reveal the underlying printed matter. Application of these materials is typically by means of flexographic printing or silk-screening. The blind section 9 is generally adhered to the patients case-record form. At the termination of the test, or if necessary, prior thereto the blinded area 11 is scratched off to reveal the ingredients and other blinded information. It should be noted that more than one blinded area can be provided.

The third section is the manufacturers record keeping section 10. On this portion of the label 1, the same information as appears in the blinded section 9 and blind area 11 thereof is provided. However, here, the information is not blinded. This section 10 is generally kept in a secure place at the site where the drug test results are submitted, e.g. the pharmaceutical manufacturers research and development department.

The construction of the novel label & carrier allows the user to feed labels into computer printers which, in turn, can be programmed to randomly assign and print any desired and or required information. Hence, this computer adapted label allows information to be affixed to scratch-off labels on a carrier sheet via computer printers instead of by older and more time consuming manual methods. Further, the size of the label, and number of perforated sections can be customized to suit the users needs.

The pressure sensitive adhesive used on the label may be clear or opaque. Generally, the adhesive is preferably opacified by adding opaque filler or pigment to the adhesive composition. Alternatively, the back of the label material may have an opaque ink applied thereto prior to the application of the adhesive to the back of the label material. An opaque back is preferred when a label is covering a dispenser which has prior printed information thereon or when the container is clear.

FIG. 2 is an elevational view of another embodiment of the invention wherein a backing sheet (not shown) has thereon a label sheet 21 which has a series of pressure sensitive adhesive labels 22 thereon, the labels 22 having a blinded section 23 an open section 24 and a record section 25 indicating what is under a 'blind' portion 26 e.g. placebo (P) or active drug (A). The sections of each label 22 as well as the various labels on a single backing sheet are separated by perforations 27 and 28 respectively, to make them easily separable, one from the other. The protocol identifier may be preprinted on the label or entered afterward. The patient identification numbers can be sequentially printed or entered by hand. For convenience, not all of the labels 22 have printing indicated thereon as depicted in the Figures.

It should be understood that the backing sheet may be of any size to contain any given number of labels thereon including a single label on an individual backing sheet. Further when a plurality of labels are affixed to a single backing sheet they may be separable by means other than perforations, e.g. by die-cutting or guillotine cutting of the labels. In addition, it is preferred that when the labels are to be used with a typewriter or the like for entering information thereon, e.g. patient number, that a blank area 29 be provided at the top and bottom to accomodate entry into the typewriter.

What is claimed is:

1. At least one pressure sensitive label comprising a backing sheet having at least one removable, double blind self adhesive label affixed thereto, said label separable into at least two sections, said sections including a blind section comprising a blinded area having information printed thereon, a clear lacquer-like coating thereover and an opaque scratch-removable coating over said lacquer-like coating, an open section and a record keeping section which identifies the blinded information.

2. A multiplicity of pressure sensitive double-blind test labels on a carrier sheet comprising a continuous carrier sheet having a multiplicity of multisection, removable, self adhesive labels affixed to a central portion thereof, the sections of each of said labels being separable by means of vertically extending closely spaced perforations in said labels said sections including an open section for affixing to a test material dispenser and having printed matter thereon which states the test protocol number, recipient identification number and dissemination directions, but not activity information, a blind section which includes a scratch removable blinded area having printed thereunder blind test information such as whether a placebo or active material was disseminated, said blind section further including printed information as contained on said open section said blind section being for retention by test administrator and a record keeping section to be kept with the manufacturer or agency and having printed thereon information to identify the particular protocol and test material activity.

3. The labels recited in claim 2 further include a multiciplicity of spaced line holes adjacent the edges of said carrier sheet of such size and spacing as to adapt said carrier sheet for use with computer printers.

* * * * *